US011473823B2

(12) United States Patent
Dany

(10) Patent No.: US 11,473,823 B2
(45) Date of Patent: Oct. 18, 2022

(54) ICE CLAMPING DEVICE

(71) Applicant: Andrew Jason Dany, Mahwah, NJ (US)

(72) Inventor: Andrew Jason Dany, Mahwah, NJ (US)

( * ) Notice: Subject to any disclaimer, the term of this patent is extended or adjusted under 35 U.S.C. 154(b) by 336 days.

(21) Appl. No.: 16/679,218

(22) Filed: Nov. 10, 2019

(65) Prior Publication Data

US 2021/0140696 A1 May 13, 2021

(51) Int. Cl.

| | |
|---|---|
| ***F25C 5/00*** | (2018.01) |
| ***A47L 13/46*** | (2006.01) |
| ***B25G 3/24*** | (2006.01) |
| ***B08B 7/00*** | (2006.01) |
| ***F25C 5/04*** | (2006.01) |

(52) U.S. Cl.

CPC ..... *F25C 5/00* (2013.01); *A47L 13/46* (2013.01); *B08B 7/0092* (2013.01); *B25G 3/24* (2013.01); *F25C 5/043* (2013.01)

(58) Field of Classification Search

CPC ..... F25C 5/00; F25C 5/02; F25C 5/043; A47J 37/0786; A47L 13/46; B25B 27/00; B66C 1/48; B08B 7/0092; B25G 3/24; A46B 7/04; A46B 7/042

USPC ..... 269/238–239, 3, 6, 143, 254 cs, 249

See application file for complete search history.

(56) References Cited

U.S. PATENT DOCUMENTS

| | | | | | |
|---|---|---|---|---|---|
| 155,469 | A | * | 9/1874 | Seymour | A47L 13/46 15/153 |
| 684,155 | A | * | 10/1901 | Wilburn | A47L 13/46 15/150 |
| 1,240,742 | A | * | 9/1917 | Lister | A47L 13/46 15/148 |
| 1,927,731 | A | * | 9/1933 | Badger | B66C 1/58 294/16 |
| 3,743,234 | A | * | 7/1973 | Pietrzak | A47G 21/10 249/71 |

FOREIGN PATENT DOCUMENTS

| | | | | | |
|---|---|---|---|---|---|
| CN | 201101366 | Y | * | 8/2008 | |
| FR | 444801 | A | * | 10/1912 | A47L 13/46 |

* cited by examiner

*Primary Examiner* — Daniel J Colilla

(74) *Attorney, Agent, or Firm* — Michael J. Feigin, Esq.; Feigin and Fridman LLC

(57) ABSTRACT

With the components assembled and the ice block formed, the Ice clamping device will allow the user a safe and effective way use the ice block to clean a food grade grilling surface. Thereby cleaning the grilling surface without direct metal on metal contact with that surface there by eliminating the issues and hazards assorted with those cleaning tools i.e. metal from wire bristles or broken material that can be ingested.

10 Claims, 2 Drawing Sheets

ICE CLAMPING DEVICE

FIELD OF THE INVENTION

A device to clean a food grade grilling surface without direct metal on metal contact eliminating the issues and hazards that are inherent in using those cleaning tools i.e. metal from wire bristles or broken material that can be ingested.

A device to secure a block of ice in a holder and handle which then gives the ability to use the ice as a cleaning agent in a safe and efficient way.

BRIEF SUMMARY OF THE INVENTION

The spring loaded clamping device is used in a method by which a block of ice is held in place at the end of the long handle. This device allows the ice to be held tightly at the end of the handle and used as a cleaning agent on a hot surface, allowing the device to be used to clean that surface. The handle also keeps the user at a safe distance away from the heat source during the cleaning process.

REFERENCE NUMBERS

The following reference numbers used in this disclosure are as follows:

2 Main Handle
3 Front Scraper Plate
4 Screw Pan Head
5 Rear Spring Plate
6 Pivot Point
7 Pivot Screw
8 Compression Spring
9 Releasing Lever

DETAILED DESCRIPTION OF THE INVENTION

Figure 1:
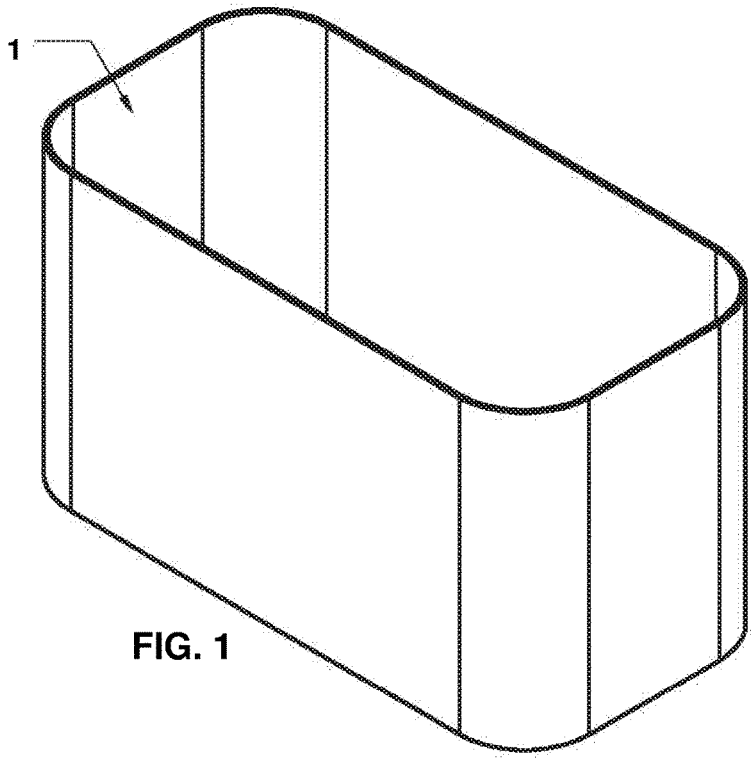
FIG. 1 shows a perspective view of a freezer safe container which can be filled with water.
Figure 2:
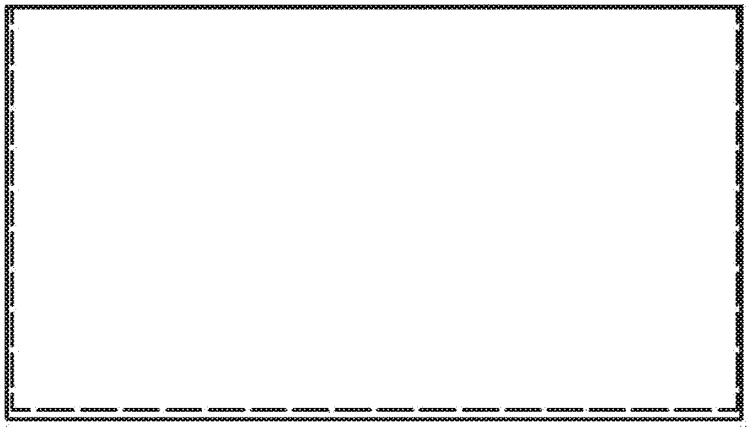
FIG. 2 shows a top plan view of the container of FIG. 1.

FIG. 1 shows a perspective view of a freezer safe container which can be filled with water. FIG. 2 shows a top plan view of the container of FIG. 1.

Figure 3:
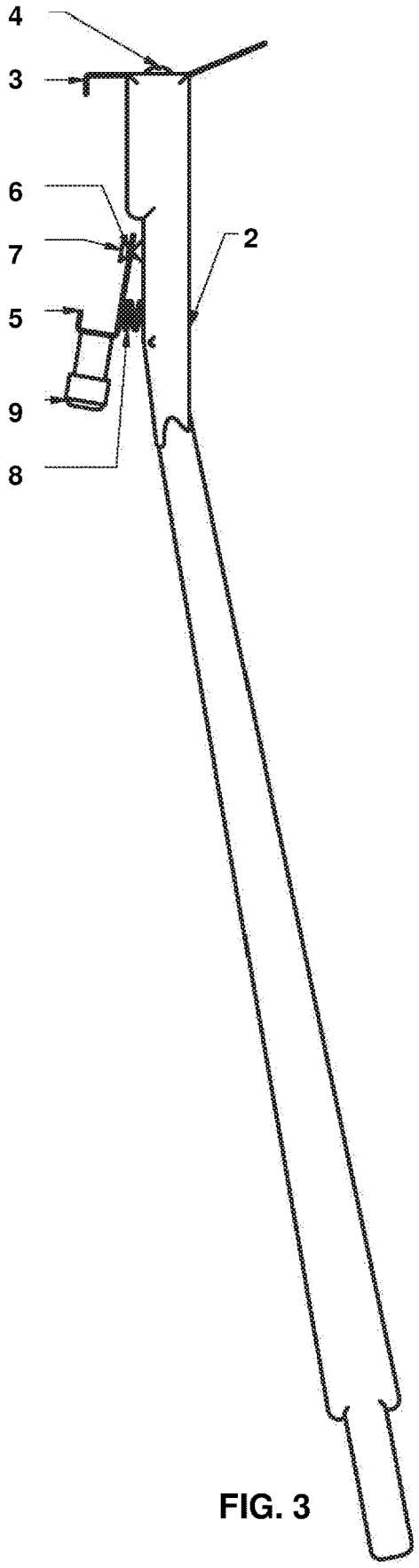
FIG. 3 shows an ice clamping device.

A freezer safe container 1 makes a block of ice that is the correct size to fit between a front scraper plate 3 [shown in FIG. 3.] and a rear spring plate 5. This container is filled with water and frozen be means of lowering the temperature below 32 degrees. When ready for use the ice block is removed from the container and installed between the front scraper plate 3 and the rear spring plate 5.

FIG. 3 shows an ice clamping device.

A main handle 2 is made from a hard durable plastic formed in the injection molding process where molten plastic is forced into a mold containing the handle size and dimension and then allowed to cool. The handle 2 is then removed from the mold and the process can start again. This handle is the platform where all the other parts are connected to. During use the handle 2 will keep the user away from the heat source during the cleaning process.

A front scraper plate 3 is made of a non-corrosive material such as stainless steel or other coating that is able to withstand high temperatures, the outdoor elements and is food grade safe. The front scraper plate is formed in a stamping process to make a size and shape needed. The front scraper plate is then be bent with a metal press to the correct shape to allow the front scraper plate 3 to secure the ice block on one end and provide a scraper on the other end.

A screw pan head 4 is made from corrosion resistant material used to secure the front scraper plate 3 to the handle.

A rear spring plate 5 to be made of a non-corrosive material such as stainless steel or other coating that is able to withstand high temperatures, the outdoor elements and is food grade safe. The rear spring plate is formed in a stamping process to make the size and shape needed, and then be formed in a bending process to the correct shape where the rear spring plate is secured to the ice block against the front scraper plate 3.

A pivot point 6 is the location where the rear spring plate 5 is attached. This point will be located on the main handle 2 providing a hinge for the rear spring plate 5 to move up and down allowing opening and then closing to securing the block of ice between the rear spring plate 5 and the front scraper plate 3.

A Pivot screw 6 made from corrosion resistant material is used to hold the rear spring plate 5 to the handle and allow the spring plate 5 to pivot.

Compression spring 8, made from corrosion resistant material, provides the locking force needed to hold the ice in place during the cleaning process.

A release lever 7 is made from a hard durable plastic with internal threads which will allow the release level to be secured to the rear spring (releasing) lever 9. This will proving a leverage point allowing the user to compress the spring, opening the rear locking plate 5 providing the room needed to install or remove the block of ice.

With the components listed above and assembled as depicted on FIGS. 1, 2, and 3 the device will allow the user the ability to safely and securely hold a pre-formed block of ice between the front scraper plate and the rear spring plate. Once this pre-formed block of ice is securely held at the end of the handle it allows the user to effectively clean a hot grilling surface by rubbing the ice along the hot surface. This action melts the ice producing steam and water. This melting action cleans the surface without any metal on metal contact thereby eliminating the potential hazards assorted with those types of cleaning tools.

What is claimed is:

1. An ice clamping device, comprising:

a handle;

an L-shaped front scraper plate attached to said handle and extending outward therefrom with a bent end opposite said handle;

an J-shaped rear spring plate attached to said handle by way of a pivot screw and a compression spring, wherein said pivot screw allows said J-shaped rear spring plate to pivot relative to said handle, said pivoting limited by said compression spring;

an opening between the front scraper and rear spring plate sized to fit a block of ice held between said front scraper and said rear spring plate.

2. The ice clamping device of claim 1, wherein said opening is surrounded by, in order:

said handle;

two sides of said L-shaped front scraper plate;

a portal opposite said handle; and three sides of said J-shaped rear spring plate terminating at said handle.

3. The ice clamping device of claim 1, wherein said device is adapted to allow ice abutted against said handle and said front scraper plate to be rubbed against another object.

4. The ice clamping device of claim 3, wherein a screw pan head extending between said L-shaped front scraper plate and said handle secures said front scraper plate to said handle a side of said handle perpendicular to a side of said handle which surrounds said opening.

5. The ice clamping device of claim 4, wherein a threaded releasing lever determines an angle of said rear spring plate to said handle.

6. A kit comprising said ice clamping device of claim 1 and a container, said container having an interior length equal to that of a distance between said L-shaped front scraper plate and said J-shaped rear spring plate.

7. The kit of claim 6, wherein said container further has an interior width equal to that of a distance between said handle and said bent end opposite said handle.

8. The kit of claim 7, wherein said container is adapted to hold a block of ice of a first size and said ice clamping device is adapted to hold said block of ice of said first size such that said container and said clamping device are paired for making and scraping said block of ice of said first size.

9. A method of using said kit of claim 8, wherein:

said block of ice is formed in said container;

said block of ice is secured to said handle;

said block of ice is rubbed against a surface;

said block of ice is melted.

10. The ice clamping device of claim 1, wherein each said of said L-shaped front scraper plate, said J-shaped rear spring plate, and a portion of said handle between said L-shaped front scraper plate and said J-shaped rear spring plate, are flat.

* * * * *